United States Patent [19]

Kubiak

[11] 4,316,558

[45] Feb. 23, 1982

[54] APPARATUS FOR PIPETTING DILUENT INTO A SEALED MEDICAL CONTAINER

[76] Inventor: Robert J. Kubiak, 8042 Old E, Rte. 1, Omro, Wis. 54963

[21] Appl. No.: 114,070

[22] Filed: Jan. 21, 1980

[51] Int. Cl.[3] ..... B67D 5/06

[52] U.S. Cl. ..... 222/181; 222/327; 222/386

[58] Field of Search ..... 222/173, 325, 326, 327, 222/386, 387, 388, 181, 185, 309

[56] References Cited

U.S. PATENT DOCUMENTS

| | | | |
|---|---|---|---|
| 203,194 | 4/1978 | Rhoades | 222/386 X |
| 1,594,200 | 7/1926 | Hill | 222/327 |
| 3,444,906 | 5/1969 | Moonan et al. | 222/326 |
| 3,456,849 | 7/1969 | Sjestrand | 211/327 X |

*Primary Examiner*—Allen N. Knowles
*Attorney, Agent, or Firm*—Ronald E. Barry

[57] ABSTRACT

An apparatus for dispensing diluent from a large volume syringe, into a sealed medical container, the apparatus including a frame, a syringe supporting bracket assembly, and a lever or handle pivotally mounted on the frame and a compensating link connecting the handle to the plunger of the syringe, the plunger being moved by the pivotal movement of the lever to dispense a predetermined amount of diluent from the syringe into the container.

7 Claims, 3 Drawing Figures

APPARATUS FOR PIPETTING DILUENT INTO A SEALED MEDICAL CONTAINER

BACKGROUND OF THE INVENTION

Medication which is to be introduced intravenously into a patient is supplied in sealed containers. The medication generally has to be diluted depending upon the requirements of the patient prior to feeding. Dilution of the medication is accomplished by inserting the needle of a large volume (30–50 ml) syringe through the sealed cap of the medication container to introduce a sterile fluid or other diluent into the medication within the container. The operator has to hold the medication in one hand, insert the needle of the syringe through the cap of the medication container with the other hand and then depressed the plunger to force the diluent through the restricted opening of the needle until the required amount to introduce the proper amount of diluent into the container. Because of the size of the syringe, it is difficult to hold and manipulate. Accuracy of the amount dispensed is difficult to achieve because of the fluid resistance to movement of the plunger and the difficulty in simultaneously holding both the container and the plunger at the time the plunger is depressed to introduce the diluent into the container.

SUMMARY OF THE INVENTION

The dispensing apparatus of the present invention provides a simple and accurate means of dispensing diluent from a large volume plunger actuated syringe into sealed medication containers. The plunger actuated syringe which is used to introduce the diluent into the container is supported on a fixed column with the needle inserted through the cap of the container. The plunger of the syringe is actuated by a low actuating force lever to move the plunger and build up pressure in the syringe to force the diluent through the needle. Due to the low force required to actuate the plunger, the operator can operate the apparatus with one hand and observe closely the amount of diluent being dispensed from the syringe.

DRAWINGS

DESCRIPTION

Figure 1:
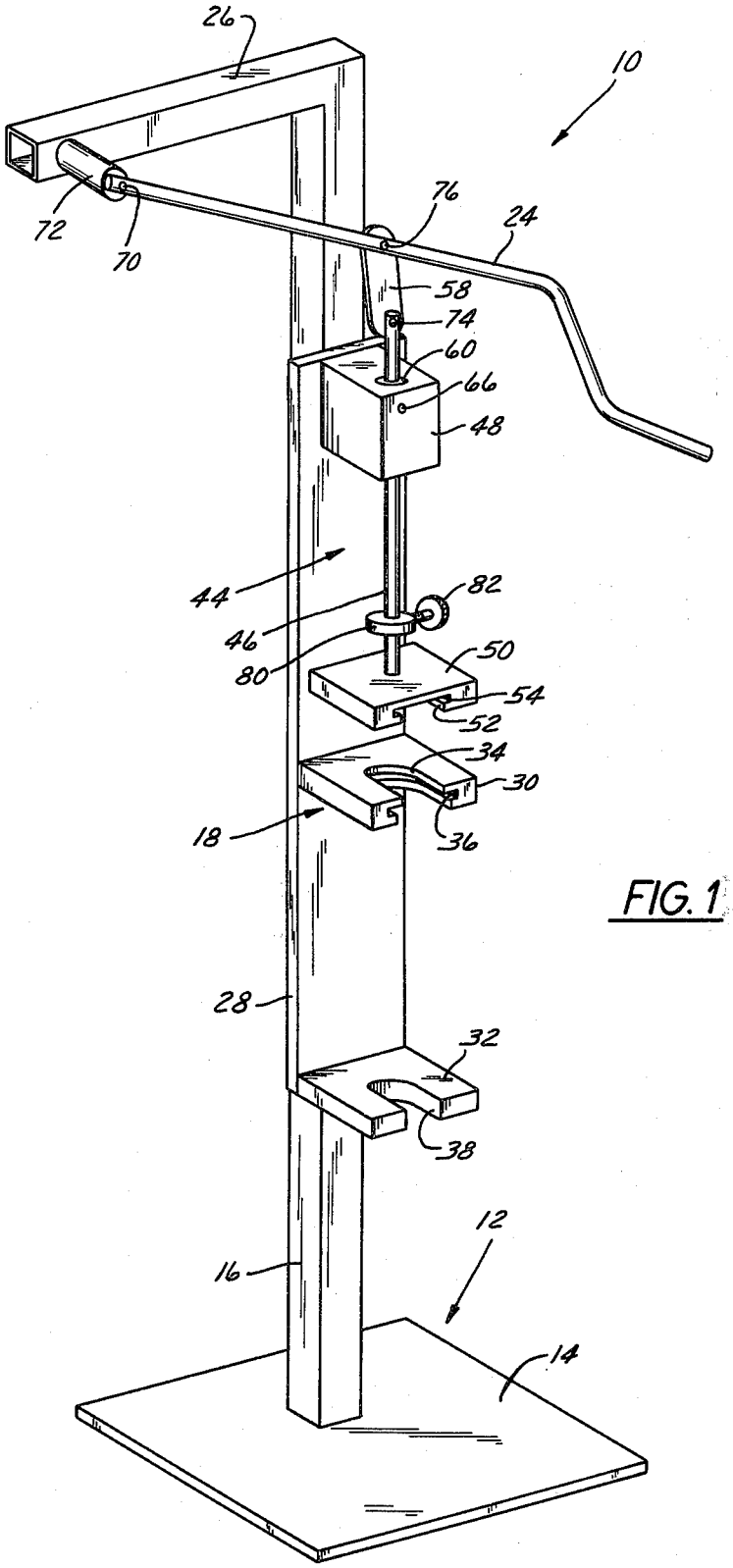
FIG. 1 is a perspective view of the dispensing device.
Figure 2:
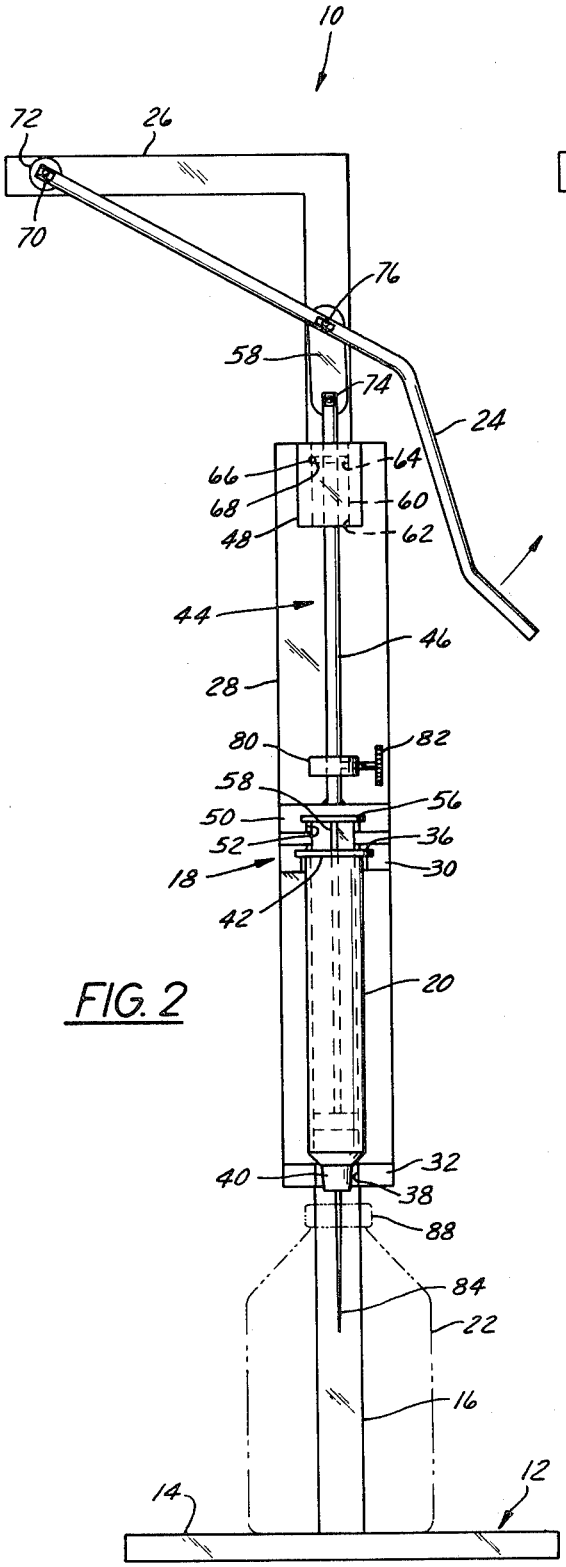
FIG. 2 is a front elevation view of the dispensing device with the plunger elevated to a position to initiate the introduction of fluid into the medicant container.
Figure 3:
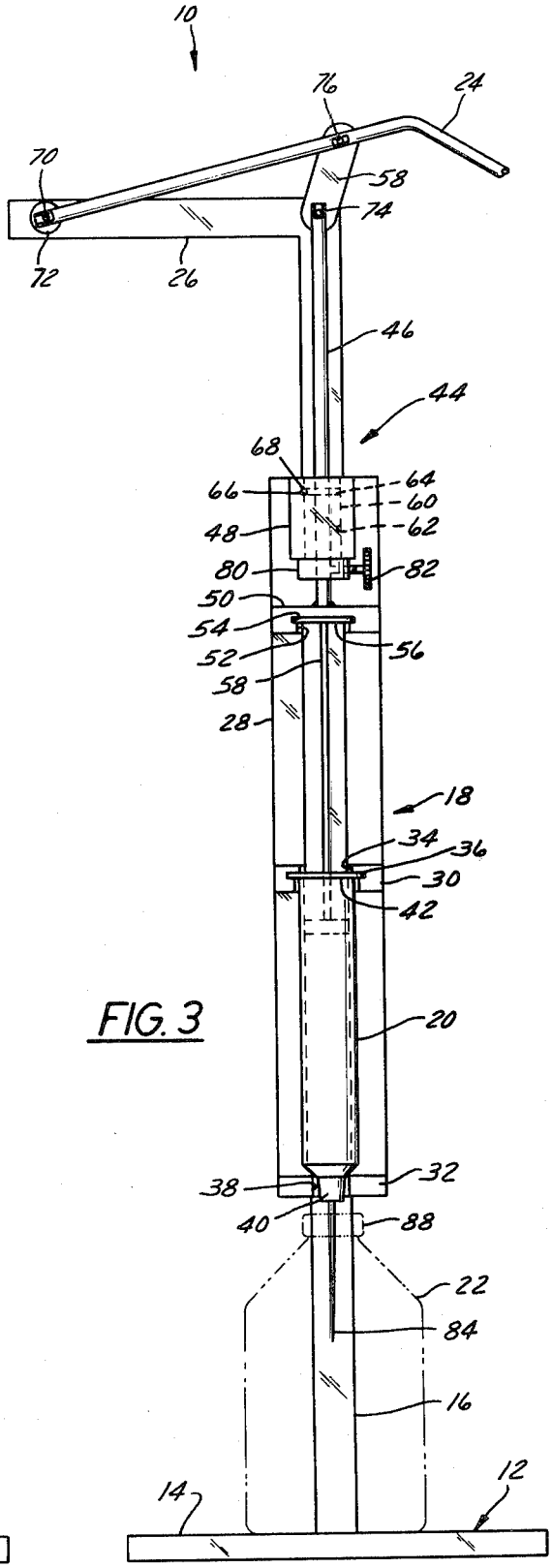
FIG. 3 is a front elevation view of the dispensing device shown in a position after dispensing medicant into the container.

As seen in the drawings, the syringe dispensing apparatus 10 generally includes a support assembly 12 having a base 14 and a support column 16. Means are provided on the support column 16 in the form of a mounting bracket assembly 18 for supporting and actuating a high volume syringe 20 to dispense diluent or fluid into a sealed medication bottle or container 22. Positive control of the amount of diluent to be dispensed from the syringe 20 is provided by means of a low actuating force arm or lever 24 pivotally mounted on the support assembly 12.

More particularly the support assembly 12 includes the base 14, the support column 16 and a horizontal support arm 26. The syringe 20 is supported on the support column 16 by means of the bracket assembly 18.

In this regard the bracket assembly 18 includes a mounting plate 28 having an upper support bracket 30 and a lower support bracket 32. The upper support bracket 30 includes a recess 34 and an arcuate groove 36 around the inside surface of the groove 34. The lower bracket 32 includes an arcuate recess 38.

The syringe 20 is mounted on mounting bracket assembly 18 by inserting the lower end 40 of the syringe into the recess 38 and the flange 42 at the upper end of the syringe into the groove 36 in the bracket 30.

The syringe 20 is actuated by means of an actuating assembly 44 mounted on the mounting plate 28. The actuating assembly 44 includes a plunger rod 46 mounted for axial movement in a rod bearing block 48 which is secured to the plate 28. A plunger plate 50 is mounted on one end of the rod 46. Means in the form of an opening 52 and a groove 54 around the inside surface of the opening 52 is provided on plate 50 to engage the flange 56 on the upper end of the plunger 58 of the syringe 20.

The actuating assembly 44 is supported on the plate 20 by means of a plunger holder rod bearing block 48 which is provided with a bearing 60 located in a bore 62. The bearing is provided with a groove 64 and is retained in the bore 62 by means of a pin 66 inserted into an opening 68 in the bearing housing to engage the groove 64.

The actuating lever 24 is secured to the support arm 26 by means of a pivot pin 70 and is spaced therefrom by means of a spacer 72. The spacer 72 has a length sufficient to align the lever 24 with the axis of the plunger rod 46.

The arcuate movement of the lever 24 when pivoted about the pin 70 is compensated for by means of the link 58. In this regard, the link 58 is pivotally connected to the upper end of the plunger rod 46 by means of a pin 74 and to the lever arm by means of a pin 76. It should be noted that the pivot point of the lever 24 is located on the opposite side of the link 58 from the handle 78 in order to minimize the force required to move the syringe plunger 58.

Means are provided on the plunger rod 46 for limiting the travel of the rod with respect to the syringe 20. Such means is in the form of an adjustible stop 80 mounted on the rod 46 and having a thumb screw 82 to adjustably locate the stop on the rod 46.

In operation a high volume (30 ml or more) syringe 20 is placed between the upper and lower brackets 30 and 32 with the flange 42 on the upper end of the syringe positioned in the groove 36 and the lower end 40 positioned in the recess 38 in bracket 32. The lever 24 is raised to a height sufficient for the flange 56 on the upper end of the syringe plunger 58 to fit in the groove 54 in the plate 50. The adjustable stop 80 is moved into engagement with the lower surface of the bearing housing 48 and the thumb screw 82 turned to seat the adjustable stop on the plunger. The apparatus is thus set for the proper height of a particular size syringe. However, it should be noted that the location of the plate 50 can be adjusted to accommodate various length plungers by merely relocating the stop 80 on the rod 46.

The syringe is connected to the bottle 22 by means of a needle 84 which is inserted into the resealable cap 88 of the container 40. The actuating lever 24 is then moved downward manually to force the diluent or fluid from the disposable syringe through the needle and into the container 22. The needle has a very small opening and considerable force has to be built up in the syringe in order to dispense the fluid.

With this arrangment, a low effort is required to dispense the fluid with a positive control of the amount of fluid being forced into the container. The operator can observe the position of the plunger and thus accurately dispense the predetermined amount of diluent in the container.

The embodiments of the invention in which an exclusive property and privilege is claimed are defined as follows:

1. A syringe dispensing apparatus comprising a base, support column mounted on said base and having a support arm extending transversely to the axis of the support column, means mounted on the support column for supporting a plunger actuated syringe, an actuating lever pivotally mounted on the support arm, plunger means for connecting said actuating lever to the plunger of a syringe, means mounted on the support column for guiding the axial movement of the plunger means with respect to the syringe plunger, whereby pivotal movement of the actuating lever on the support arm will move the syringe plunger axially into the housing of the syringe to dispense fluid from the syringe.

2. The apparatus according to claim 1 wherein said plunger means includes a rod and a connecting link pivotally connecting said lever to said rod.

3. The apparatus according to claim 2 wherein said plunger means includes a travel stop to limit the upward movement of the syringe plunger.

4. A dispensing apparatus for a high volume plunger actuated syringe, said apparatus comprising a base, support means on said base for supporting the syringe, an actuating lever pivotally mounted on said support means, plunger means for operatively connecting said lever to the plunger of the syringe, link means connecting said lever to said plunger means, and guide means on said support means for providing a predetermined path of motion for said plunger means whereby pivotal movement of said actuating lever produces axial movement of said plunger means to move the plunger of the syringe and dispense a controlled amount of fluid from said syringe.

5. The apparatus according to claim 4 wherein said plunger means includes a rod, and said guide means operatively engaging said rod to maintain said rod in alignment with the axis of said plunger whereby the pivotal movement of said lever is compensated for by said link means.

6. The apparatus according to claim 5 including a travel stop on said rod to limit the travel of said plunger means whereby the amount of fluid to be dispensed can be accurately controlled.

7. A dispensing apparatus for a high volume plunger actuated syringe, said apparatus comprising a base, support means on said base for supporting the syringe, an actuating lever pivotally mounted on said support means, link means connecting said lever to the plunger of said syringe, and guide means on said support means for providing a predetermined path of motion for said plunger whereby pivotal movement of said actuating lever produces axial movement of said plunger to dispense controlled amounts of fluid from said syringe, said link means including a rod operatively connected to said plunger, said guide means operatively engaging said rod to maintain said rod in alignment with the axis of said plunger, whereby the pivotal movement of said lever is compensated for by said link, and, a travel stop mounted on said rod to limit the travel of said plunger thereby controlling the amount of fluid to be dispensed.

* * * * *